US007954428B2

(12) United States Patent
Ishikawa et al.

(10) Patent No.: US 7,954,428 B2
(45) Date of Patent: Jun. 7, 2011

(54) ENDLESS PRINT BELT FOR ROTARY STAMP

(75) Inventors: Hirotoshi Ishikawa, Gifu (JP); Hirofumi Kondo, Oobu (JP); Shogo Ichise, Aichi (JP); Takahiro Higuchi, Ichinomiya (JP); Taketoshi Ota, Nagoya (JP)

(73) Assignee: Shachihata Inc., Nagoya-Shi (JP)

( * ) Notice: Subject to any disclaimer, the term of this patent is extended or adjusted under 35 U.S.C. 154(b) by 561 days.

(21) Appl. No.: 12/054,652

(22) Filed: Mar. 25, 2008

(65) Prior Publication Data

US 2008/0236416 A1 Oct. 2, 2008

(30) Foreign Application Priority Data

Mar. 27, 2007 (JP) ..... 2007-081973
Feb. 28, 2008 (JP) ..... 2008-047477

(51) Int. Cl.
*B41J 27/00* (2006.01)

(52) U.S. Cl. ..... 101/111; 101/105; 101/368

(58) Field of Classification Search ..... 101/105, 101/111, 327, 368
See application file for complete search history.

(56) References Cited

U.S. PATENT DOCUMENTS

| | | | | |
|---|---|---|---|---|
| 2,950,048 | A * | 8/1960 | Luhn | 235/61 A |
| 2,975,702 | A * | 3/1961 | Hutzelman | 101/99 |
| 3,476,657 | A * | 11/1969 | Lundquist | |
| 3,506,749 | A * | 4/1970 | Weissman | |
| 3,977,321 | A * | 8/1976 | Pabodie | |
| 4,006,680 | A * | 2/1977 | Grace, Jr. et al. | |
| 4,119,030 | A * | 10/1978 | Funahashi | |
| 4,263,242 | A * | 4/1981 | Jenkins | |
| 4,290,358 | A * | 9/1981 | Hamisch, Jr. | |
| 4,337,698 | A * | 7/1982 | Jenkins | |
| 5,577,444 | A * | 11/1996 | Toyama | |
| 5,799,576 | A * | 9/1998 | Koike et al. | |
| 5,983,789 | A * | 11/1999 | Fogle | |
| 6,352,024 | B1 * | 3/2002 | Childress | |
| 6,634,288 | B1 * | 10/2003 | Imamaki et al. | |

FOREIGN PATENT DOCUMENTS

| | | | |
|---|---|---|---|
| CN | 2179824 | Y | 10/1994 |
| JP | 11-129595 | A1 | 5/1999 |
| JP | 11-129596 | A1 | 5/1999 |

* cited by examiner

*Primary Examiner* — Ren Yan
(74) *Attorney, Agent, or Firm* — Burr & Brown

(57) ABSTRACT

An endless print belt for rotary stamp in which a plurality of print sections are disposed and spaced-out between each other on a surface of a print belt main body, with at least the print surface of the print section being formed of porous material, wherein a groove in the width direction is formed at an intermediate position of each spaced-out part. Preferably, the spaced-out part is formed such that the surface thereof is in a non-porous state and both ends of the groove are formed into a bund part, for preventing ink from running out.

5 Claims, 3 Drawing Sheets

ENDLESS PRINT BELT FOR ROTARY STAMP

BACKGROUND OF THE INVENTION

1. Field of the Invention

The present invention relates to an endless print belt for rotary stamp of which a plurality of print sections are spaced out between each other and disposed on the surface of an endless print belt with at least a front surface of the print section being formed of porous material.

2. Description of the Prior Art

The endless print belt for rotary stamp of which a plurality of print sections are spaced out between each other and are disposed on the surface of the print belt main body with at least the front print surface of which is formed of porous material has been widely used for rotary stamps which can simply print a date, or a date with company's name, department name and the like all on a master stamp at the same time (see, for example, Patent Documents 1 and 2).

However, if the thickness of the spaced-out part between the print sections of the endless print belt for intensifying the strength is increased in the endless print belt for rotary stamp as described in the patent documents 1 and 2, the user cannot feel that a portion having each print section has passed the bridge part of the rotary stamp frame, when the user operates the rotary stamp after changing the print face and thus the user needs to confirm by sight and each time that the print face has been changed, thereby making the operation for changing the print face problematic and troublesome.

Patent Document 1: Japanese Patent Application Publication 1999-129595

Patent Document 2: Japanese Patent Application Publication 1999-129596

SUMMARY OF THE INVENTION

Accordingly, an object of the present invention is to solve the above-described problem and provide an endless print belt for a rotary stamp which allows user to feel that the print face has been changed completely when he or she operates the endless print belt after changing the print face even if the thickness of a spaced-out part formed between the print sections is increased while enabling the print sections to be aligned appropriately, thereby eliminating the necessity of confirming that the print face has been changed visually each time.

To achieve the above-described object, there is provided an endless print belt for rotary stamp in which a plurality of print sections spaced out between each other are disposed on the surface of a print belt main body with at least a surface of the print section formed of porous material, wherein a groove in the width direction of the print belt is formed at an intermediate position of each spaced-out part.

In the endless print belt for rotary stamp of the present invention, preferably, the spaced-out part is formed such that the surface thereof is in non-porous state so as to keep the surface of the spaced-out part from being wet in ink while intensifying the strength. Although the groove in the width direction formed at the intermediate position of each spaced-out part may reach both ends of the belt main body, the both ends of the groove are preferred to be formed into an enclosing bund in order to prevent ink from running out. If the bund parts are provided, it is especially preferable that the top of the bund part is on the same plane as the surface of the spaced-out part.

According to the present invention, in the endless print belt for rotary stamp in which a plurality of print sections are disposed spaced out between each other on the surface of a print belt main body at least the surface of which is formed of porous material, the groove in the width direction of the print belt is formed at an intermediate position of each spaced-out part. Consequently, when a portion having each print section passes the bridge part of the rotary stamp frame upon operation for changing the print face, the rear face in the middle of the spaced-out part being thinned by the groove is positioned on the corner of the bridge part, so that the operating resistance is changed. Thus, the user can feel that the print face has been changed by the change in feel of the operating resistance. Thus, the user does not need to confirm visually that the print face has been changed each time, and further the groove serves as reference for arranging the print sections of the endless print belt neatly.

Further, since the surface of the spaced-out part in the endless print belt for rotary stamp is formed in the non-porous state, the surface of the spaced-out part is prevented from being wet with ink and the strength thereof is intensified, thereby increasing the durability. When the groove in the width direction formed in the middle of the spaced-out part reaches both ends of the print belt main body, the rotating operation is smooth and the user can feel that the print face has been changed securely. If both ends of the groove are formed into corresponding enclosing bund parts for preventing the ink deposited in the groove from reaching the rear face through the both ends. Accordingly, the risk of ink running-out is eliminated by the bund parts therefore keeping the surrounding spaced-out belt area from becoming stained with ink while also allowing the strength of the belt to be intensified by the bund parts. For this reason, it is especially preferable to provide that both ends of the groove with the bund parts are short as they do not block the easiness of the rotating operation nor the user from feeling that the print face has been changed. Further, if such bund parts are provided, it is preferable that the height of the bund part is formed such that the top thereof is substantially on the same plane as the surface of the space portion to also consider the effect of preventing the ink from running-out, as well as the secure feeling that the print face has been changed by the strength of the belt.

DETAILED DESCRIPTION OF THE INVENTION

Hereinafter, as a preferred embodiment of the present invention, the endless print belt for rotary stamp using the rotary stamp built in the rotary stamp with the master stamp will be described.

Figure 4:
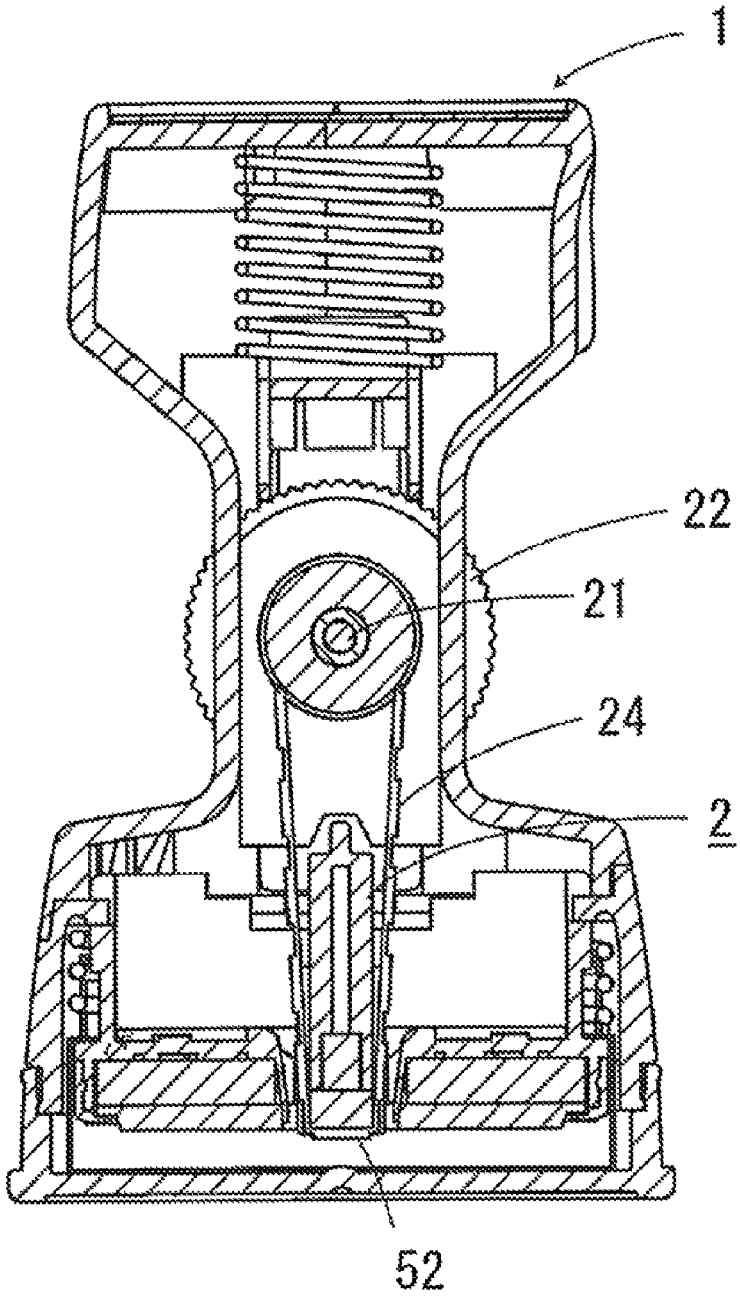
FIG. 4 is a sectional view of a rotary stamp with master stamp into which a rotary stamp using the endless print belt for the rotary stamp of the present invention is incorporated.

Referring to FIG. 4, reference numeral 1 denotes a rotary stamp main body with master stamp, reference numeral 2 denotes a rotary stamp and reference numeral 3 denotes a master stamp into which the rotary stamp 2 is incorporated. The endless print belt for rotary stamp of the present invention is applied between a plurality of rotators 22 supported rotatably by a shaft 21 provided in the middle of the rotary stamp frame of the rotary stamp 2 and the bridge part 23 provided on the bottom end of the rotary stamp frame.

Figure 1:
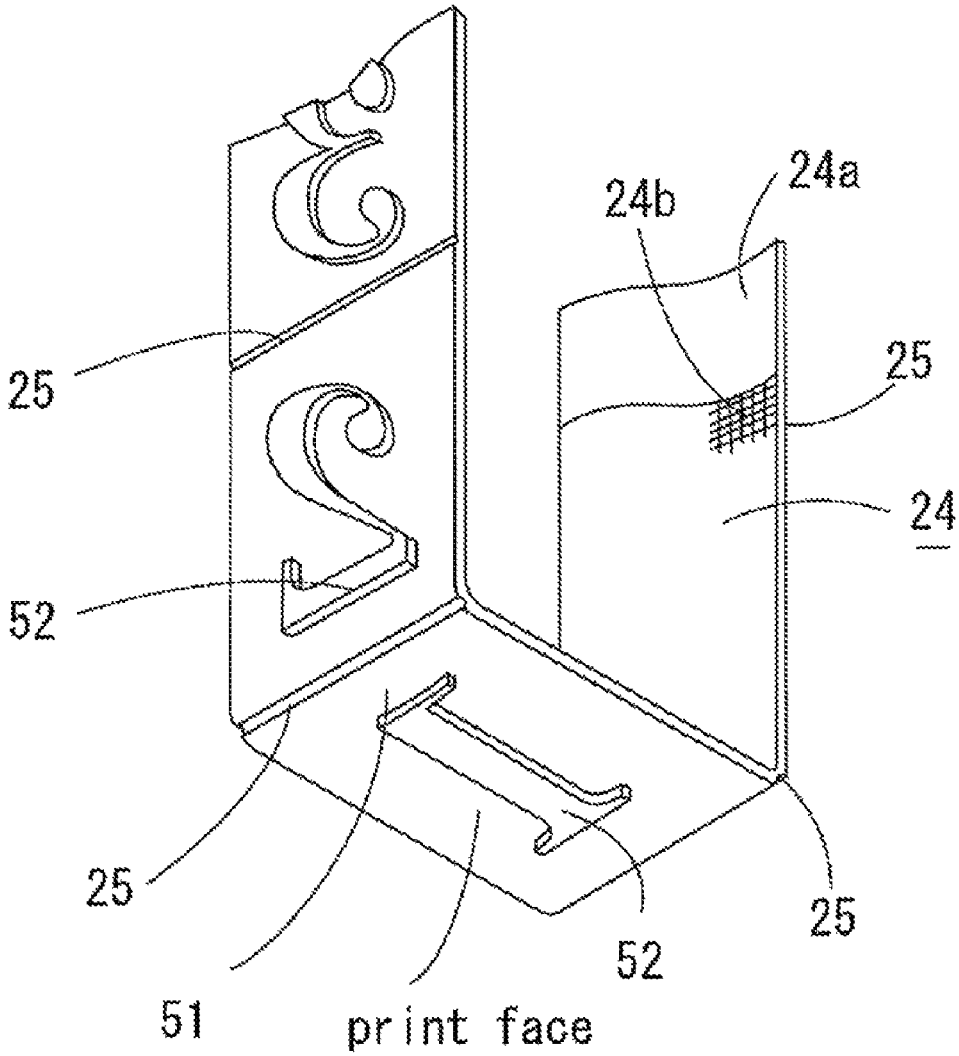
FIG. 1 is a partially broken perspective view showing major portions of a first preferred embodiment of the present invention in enlargement.
Figure 2:
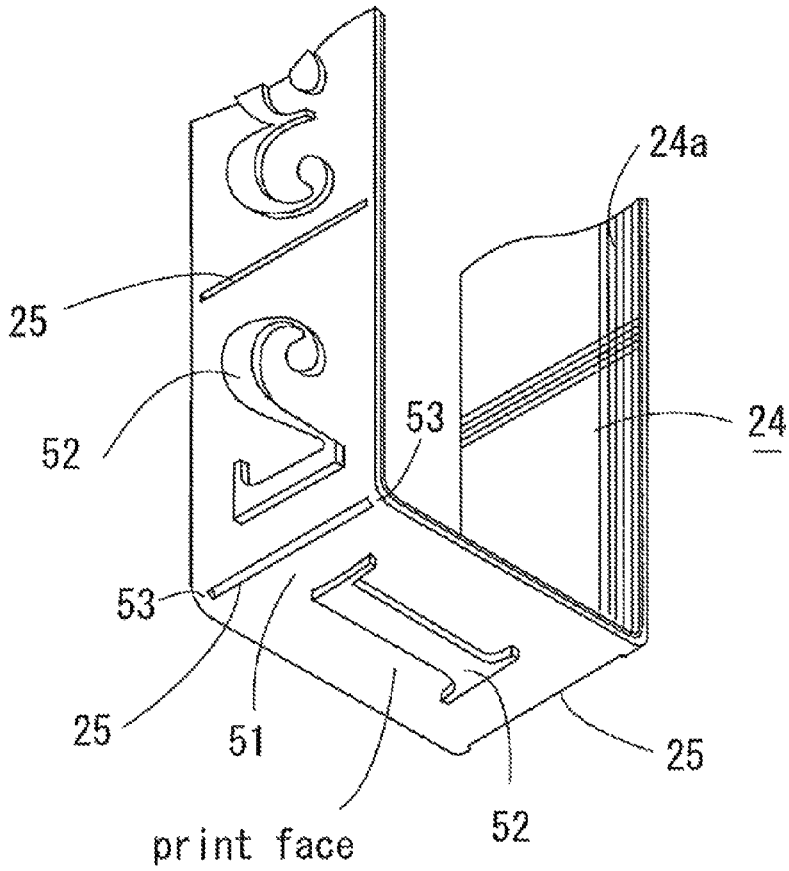
FIG. 2 is a partially broken perspective view showing major portions of a second preferred embodiment of the present invention in enlargement.
Figure 3:
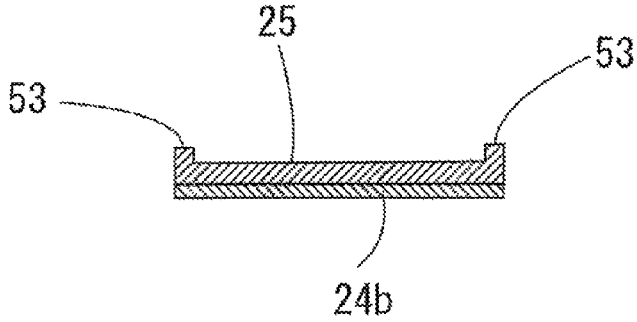
FIG. 3 is a sectional view of FIG. 2.

As shown in FIG. 1 and FIG. 2, the print belt main body 24 of the endless print belt for rotary stamp of the present invention is formed of laminated belt fabric composed of porous thermoplastic resin belt foundation 24*a* having infinite number of continuous pores such as foamed polyethylene resin as its front layer and ink circulation reinforced rear fabric 24*b* as its rear layer. By melt-processing the front surface of this laminated belt fabric, with the print section 52 kept in porous state, spaced-out part 51 between the respective print sections 52 and 52 and all portions surrounding the print sections are formed in non-porous state attained by the melt-processing so as to produce a thin melt-processed laminated belt in which the thickness of the non-porous face is 2.0 mm or less.

A groove 25 is formed in the width direction at an intermediate position between the print sections 52 and 52 for dividing the spaced-out part 51 into two sections, with the spaced-out part 51 being formed between the print sections 52 and 52 of the endless print belt main body 24. Although, as shown in FIG. 1, this groove 25 may be a groove communicating to both ends of the print belt main body 24, the both ends of the groove 25 may be formed as bund parts 53 for preventing ink from running out. If such bund parts 53 are provided, the length of these bund parts 53 are as small as 0.5 to 1.0 mm and a height thereof that may be such that the top of the bund parts 53 is substantially on the same plane as the surface of the spaced-out part 51. By providing such a groove 25, the groove is then positioned on the corner of the bridge part 23 when the print face of the print belt main body 24 is rotated and changed, therefore the user can feel that the print face has been changed without confirming visually, based on the feeling that the operation resistance has been changed. Consequently, it is not necessary to check the print face visually each time when the rotating operation is performed. When the bund parts 53 and 53 are provided, the reinforcement effect of the bund parts 53 and 53 can secure and provide improved strength even if the groove 25 is formed thinly in addition to the effect of preventing ink from running out, this is a function inherent to the addition of the bund parts 53. In the meantime, the groove 25 and portions of the bund parts 53 and 53 are preferred to be formed in a non-porous state by melt-processing or coating like the spaced-out part 51.

Although the above-described description is applied to only an endless print belt for a rotary stamp. The use in any rotary stamp incorporated into the rotary print stamp with master stamp or any endless stamp belt with rotary stamp is covered. Particularly in which a plurality of print sections are disposed and spaced out between each other on the surface of the print belt on at least a surface of which is formed of a porous material that is implemented as the endless print belt for the rotary stamp, as long as it is formed of a known material or used in a known application field.

What is claimed is:

1. An endless print belt for rotary stamp in which a plurality of print sections are disposed and spaced out between each other on a print surface of a print belt main body wherein at least the print surface of the endless belt is formed of a porous material;

wherein an outwardly open groove is formed in the width direction of the print belt at an intermediate position between adjacent print sections; and wherein both ends of the outwardly open groove are defined by bund parts that contain and prevent ink from running out of the outwardly open groove in the width direction of the print belt.

2. The endless print belt for rotary stamp according to claim 1, wherein a spaced-out part is formed between adjacent print sections such that a surface thereof is in a non-porous state.

3. The endless print belt for rotary stamp according to claim 2, wherein a top surface of the bund parts resides along the same plane as a top surface of the spaced-out part.

4. The endless print belt for rotary stamp according to claim 1, wherein the outwardly open groove has a depth that is less than the depth of the print belt.

5. The endless print belt for rotary stamp according to claim 1, wherein when viewed from a top plan view, the outwardly open groove is substantially rectangular in shape.

* * * * *